US005138865A

United States Patent [19]

Codatto

[11] Patent Number: 5,138,865

[45] Date of Patent: Aug. 18, 1992

[54] GRIPPING ASSEMBLY FOR A MANIPULATOR FOR PLATE SHEETS

[76] Inventor: Antonio Codatto, Via Alcide De Gasperi, 20, Lonigo (Vicenza), Italy

[21] Appl. No.: 690,591

[22] Filed: Apr. 23, 1991

[51] Int. Cl.[5] ..... B21D 43/00; B21D 43/10

[52] U.S. Cl. ..... 72/422; 72/420

[58] Field of Search ..... 72/307, 316, 319, 322, 72/323, 419, 420, 422

[56] References Cited

U.S. PATENT DOCUMENTS

| | | | |
|---|---|---|---|
| 4,242,898 | 1/1981 | Salvagnini | 72/307 |
| 4,510,785 | 4/1985 | Triouleyre et al. | 72/319 |
| 4,557,135 | 12/1985 | Regettli | 72/422 |
| 4,573,861 | 3/1986 | Aschauer | 72/422 |
| 4,722,214 | 2/1988 | Hayashi | 72/319 |
| 5,042,287 | 8/1991 | Sartorio | 72/422 |

FOREIGN PATENT DOCUMENTS

| | | | |
|---|---|---|---|
| 2825591 | 5/1979 | Fed. Rep. of Germany | 72/322 |
| 122619 | 5/1989 | Japan | 72/420 |

*Primary Examiner*—Robert L. Spruill
*Assistant Examiner*—Donald M. Gurley
*Attorney, Agent, or Firm*—Bucknam and Archer

[57] ABSTRACT

A gripping assembly for a manipulator for plate sheets of the type which comprises a vise having two superimposed jaws disposed around a vertical axis, the jaws being capable of gripping a single plate along its thickness, the plate having borders, the jaws being also adapted to rotate around the axis whereby each border of the plate to be folded is brought in front of the press machine. The assembly has a pair of clamps (5) disposed laterally with respect to the vise. The clamps grip firmly the plate along its thickness and permit the simultaneous displacement from jaws in the area corresponding to the vise towards the folding machine.

5 Claims, 2 Drawing Sheets

GRIPPING ASSEMBLY FOR A MANIPULATOR FOR PLATE SHEETS

The present invention relates to a gripping assembly for use in a manipulator for metallic plate sheets. Manipulators for metallic plates capable of lifting the sheets from a loading zone and to bring them to a folding press which provides for folding the sheets along one or several borders, are known. These plates, after they have been folded and soldered in a suitable manner, are utilized, for instance, in the automobile industry for the manufacture of the bodies of the auto vehicles and also in several electrodomestic applications such as refrigerators, washing machines, air conditioning units and also shelving for furniture and the like.

In particular, manipulators are known which comprise a vise with two superimposed jaws disposed along a vertical axis capable of grasping a single plate along its thickness. The two jaws have the possibility of rotating around their axis in a direction or in the opposite direction, thus causing the rotation of the plate sheet which therefore may be subjected to the folding operation corresponding to all of its borders.

Each structure of this type, however, may operate on plates having such a value of the dimension perpendicular with respect to the folding axis which is superior to a minimum value. In fact, during the folding phase, the plate is held by the members of the folding press and more specifically by a pair of counterblades with which the jaws are capable of interfering. The transversal dimensions of the jaws in addition, cannot be reduced beyond a certain limit because they must be in condition to cause rotation of the plate around its axis without problems.

A main object of the present invention is to minimize or eliminate the drawbacks mentioned hereinabove by means of a device capable of operating on plates of reduced dimensions with the same certainty and precision offered by similar devices of a known type.

This object is achieved by providing in a device of the type described hereinabove a pair of clamps disposed laterally with respect to the jaws, the clamps being capable of grasping solidly and jointly the plate and also by providing means capable of permitting the opening and closing of the clamps as well as the advancement simultaneously of the clamps towards the folding members.

According to a preferred embodiment of the invention, each clamp has a fixed claw fixed to a vertical upright to which is pivoted another claw with the possibility of being superimposed to the first claw in such a manner that the plate may be blocked between the beaks formed at the extremities of the claws. The vertical upright is capable of sliding along a horizontal guide which is placed in motion by suitable means such as hydraulic cylinders or similar means. Other means are advantageously used also for the motion of the movable claws.

The main advantage derived from the use of the device according to the present invention resides in the fact that the clamps may be brought in the immediate proximity of the counterblades which hold the plate so that it is possible to operate on plates having extremely reduced dimensions.

The functionality of the device is also increased in the case in which the counterblades mentioned hereinabove are shaped in such a manner as to present a cavity corresponding to the surface turned towards the manipulator, that is towards the exterior of the folding machine in such a manner that the extremities of the clamps may be inserted into this cavity.

These and other features of the invention will be described herein in full detail by reference to a particular embodiment by way of a non-limiting example as shown in the accompanying drawings of which:

Figure 2:
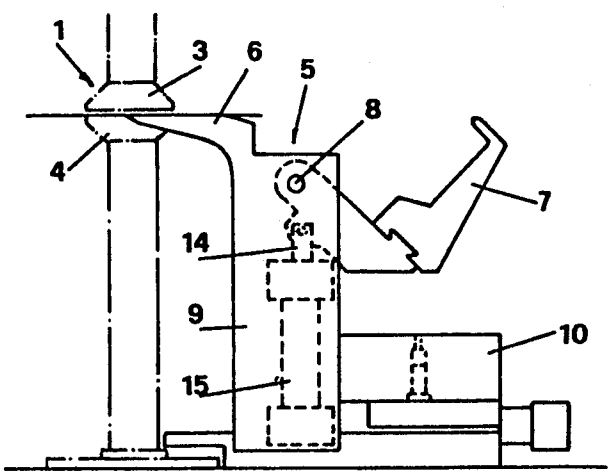
FIGS. 1–3 illustrate three views respectively: a rear view, a side view and a top view of the device according to the invention.
Figure 3:
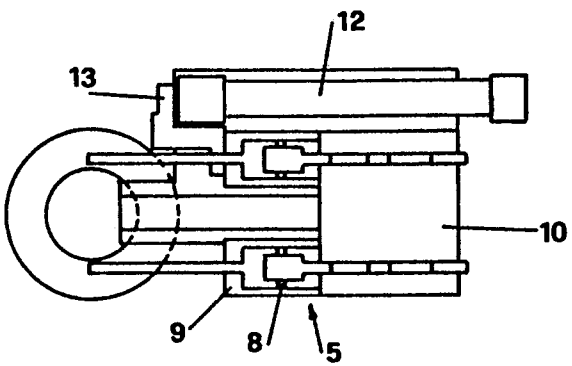
Figure 1:
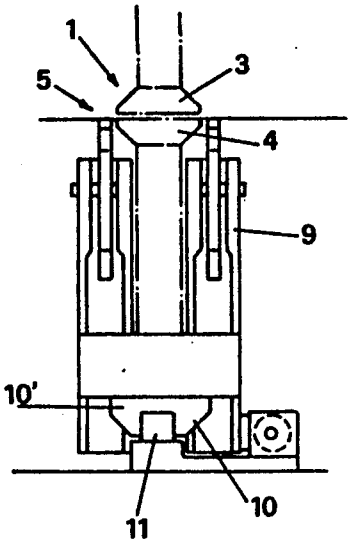
Figure 5:
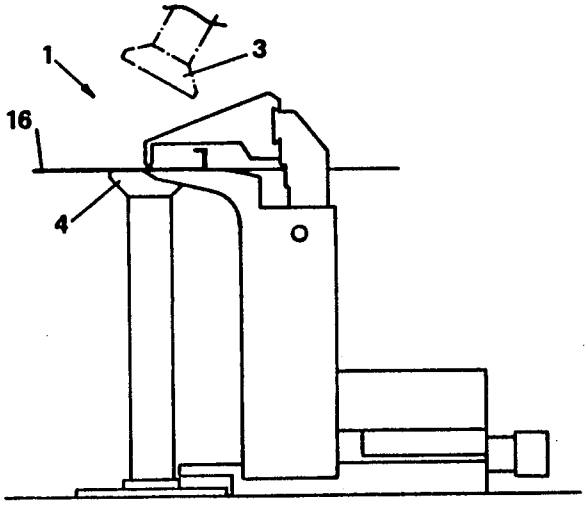
FIGS. 4 through 7 illustrate a sequence of operations being carried out with the device of the invention.

FIGS. 1 through 3 show that the device of the invention is used in a manipulator of the type which comprises a vise 1 with two jaws, 3 and 4, superimposed one over the other with the plate (not shown) inserted therebetween along its thickness. The jaws are provided with means for permitting the rotation around the common vertical axis so as to determine the rotation of the plate around the axis, for the purpose of placing the border of the plate on which one must carry out the operation in a direction parallel to the counterblades of the folding machine.

According to the invention, the gripping assembly also comprises a pair of clamps 5 disposed laterally with respect to vise 1. Advantageously the two clamps have a fixed claw 6 and a mobile claw 7 which is pivoted at the point 8 to an upright 9 which is integral with the fixed claw.

A fundamental feature of the invention resides in the fact that the clamps are movable with respect to the central vise 1 along directions perpendicular with respect to the folding axis of the plate. For this purpose, the two uprights 9 are integral with the carriage 10 which has in the lower part a guide 10', the latter sliding along the fixed rail 11.

The driving force is provided by cylinder 12, preferably hydraulically operating, the shaft of which is capable of pushing forwardly to the folding press the lateral extension 13 of the carriage.

The mobile claw 7 of the clamps may have substantially the shape of an "L". On the portion corresponding to its extremity where the claw is pivoted to the uprights, there is a shaft 14 of cylinder 15 which is also preferably actuated by hydraulic means so that it may permit the motion of the claw 7 by rotation around the pin 8.

As shown in FIGS. 4 through 7, the clamps 5 grasp plate 16 when the latter is still firmly held by the vise 1. At this point, the forward extremity of the clamps is placed substantially laterally with respect to the jaws 3 and 4 of the vise. The FIGS. 4–7 also show that the movable claw 7 of each of the two clamps forms a cavity 17 corresponding to the part which is turned towards the plate 16 when the latter is grasped by the same clamps so that the border of plate 16 which is already folded may be placed within this cavity without interfering with the same claw.

After the clamps have grasped the plate, they may be caused to advance towards the folding machine 19 after raising the upper jaw 3.

Figure 7:
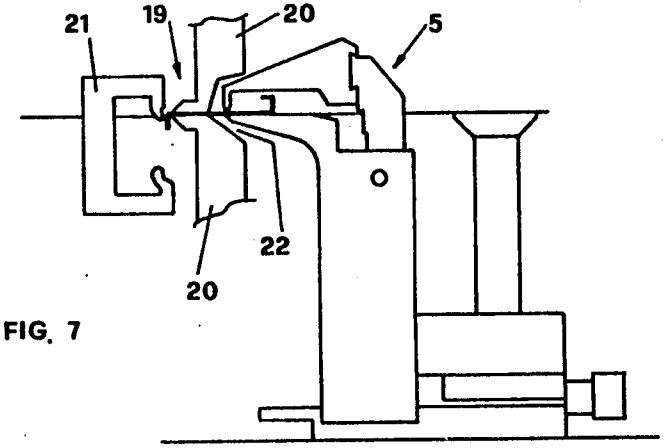
Figure 4:
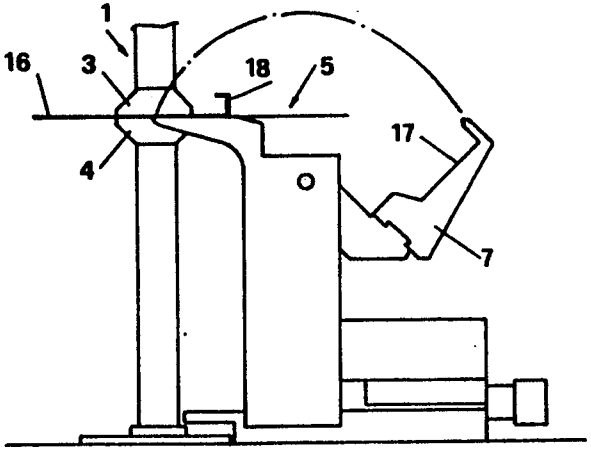
Figure 6:
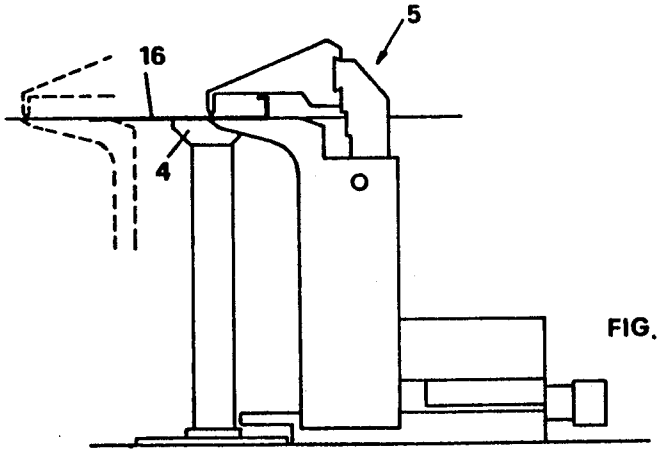

The main advantage deriving from the use of these clamps is that the same may be brought in a position extremely close to the press machine and particularly to the counterblade 20 which hold the plate in the folding phase. FIG. 7 also shows schematically the cutter block 21 which essentially carries out the folding operation.

The effectiveness of the device is particularly obtained in the case in which the counterblades 20 are shaped corresponding to their surface disposed externally with respect to the folding area in such a manner as to present a cavity 22 in which the extremities of the clamps 5 which are in the more advanced position may be inserted.

Tests have been carried out and have permitted to ascertain that by means of the device of this invention, it is possible to operate with plates in which the distance from the point in which the plate is grasped to the folding axis is about 20 millimeters, while the known devices have permitted to operate at the most with plates in which this distance has a value of about 110 millimeters. It is clear, therefore, that by means of the device of the present invention, it is possible to operate on plates which have substantially reduced dimensions with respect to what is possible to obtain by using the known devices.

When, on the other hand, one wants to turn the plate after the folding operation has been carried out, for the purpose subjecting to a folding operation on another border of the plate, is sufficient, after releasing the plate from the counterblades, to make the clamps move rearwardly up to bringing the plates again corresponding to vise 1, and this will permit to grasp the plate again, causing the plate to rotate in the desired manner. Afterwards the clamp may carry out the various operations in the sequence already described hereinabove.

What is claimed is:

1. In a gripping assembly for a manipulator for a plate sheet, said plate having borders, to fold at least one border by means of a folding machine, said folding machine having counterblades, to bring said plate in front of said folding machine and to hold said plate while said at least one border is folder, which comprises a vise, said vise having two superimposed jaws disposed on a vertical axis, said jaws being capable of gripping said plate therebetween along the thickness direction thereof, said jaws being rotatable on said axis whereby one border of said plate to be folded is brought in front of said folding machine, the improvement which consists of said assembly comprising two uprights (9) on opposite sides of said vise, a pair of clamps (5) disposed laterally with respect to said jaws, said clamps being capable of advancing towards said counterblades of said folding machine, each of said clamps having a claw (6) which is fixed to one of said uprights (9) and a claw (7) which is pivoted on said one of said uprights, said pivoted claw being L-shaped and being pivotably over said fixed claw to clamp said plate therebetween, and means for pivoting said claw.

2. The assembly according to claim 1 wherein said means for pivoting comprises a first hydraulic cylinder (15), said cylinder having a shaft (14), said shaft being connected to said pivoted claw.

3. The assembly according to claim 1 wherein both said uprights (9) are integral with a single carriage (10), said carriage forming in the interior thereof a guide, a fixed rail (11) being capable of engaging within said guide.

4. The assembly according to claim 3 which comprises means for advancing said carriage, wherein said means for advancing said carriage consists of a shaft actuated by a second cylinder, said second cylinder being a hydraulic cylinder, said carriage having a lateral extension (13), said cylinder exerting its action on the said lateral extension.

5. The gripping assembly according to claim 1 each of said pivoted claws (7) has a portion turned towards the plate when said plate is gripped by said assembly and said portion of said claw is shaped so as to form a cavity whereby the border of a plate already folded is placed within said cavity.

* * * * *